US009243630B2

(12) United States Patent
Foote

(10) Patent No.: US 9,243,630 B2
(45) Date of Patent: Jan. 26, 2016

(54) SEGMENTED FLUID END

(71) Applicant: Southwest Oilfield Products, Inc., Houston, TX (US)

(72) Inventor: Earl Foote, Houston, TX (US)

(73) Assignee: SOUTHWEST OILFIELD PRODUCTS, INC., Houston, TX (US)

( * ) Notice: Subject to any disclaimer, the term of this patent is extended or adjusted under 35 U.S.C. 154(b) by 0 days.

(21) Appl. No.: 14/349,769

(22) PCT Filed: Oct. 16, 2013

(86) PCT No.: PCT/US2013/065182

§ 371 (c)(1),
(2) Date: Apr. 4, 2014

(87) PCT Pub. No.: WO2014/062768

PCT Pub. Date: Apr. 24, 2014

(65) Prior Publication Data

US 2015/0147194 A1 May 28, 2015

Related U.S. Application Data

(60) Provisional application No. 61/715,140, filed on Oct. 17, 2012.

(51) Int. Cl.
*F04B 53/00* (2006.01)
*F04B 53/14* (2006.01)
*F04B 53/16* (2006.01)

(52) U.S. Cl.
CPC ..... *F04B 53/007* (2013.01); *F04B 53/14* (2013.01); *F04B 53/144* (2013.01); *F04B 53/16* (2013.01)

(58) Field of Classification Search
CPC ..... F04B 53/162; F04B 53/007; F04B 53/16; F04B 53/144; F04B 53/14
USPC ..... 92/169.1
See application file for complete search history.

(56) References Cited

U.S. PATENT DOCUMENTS 5,171,136 A * 12/1992 Pacht ..... 417/571
5,362,215 A * 11/1994 King ..... 417/455

(Continued)

FOREIGN PATENT DOCUMENTS

WO 2014062768 A1 4/2014

OTHER PUBLICATIONS

International Search Report and Written Opinion for PCT/US2013/065182 dated Jan. 24, 2014.

*Primary Examiner* — Nathaniel Wiehe
*Assistant Examiner* — Abiy Teka
(74) *Attorney, Agent, or Firm* — Conley Rose, P.C.

(57) ABSTRACT

Disclosed is an improved segmented fluid end for high-pressure plunger pumps. One segmented fluid end includes one or more fluid end modules, each fluid end module including a body providing a plunger bore configured to receive a plunger therein and a discharge outlet in fluid communication with the plunger bore, wherein a pressurized working fluid may exit the body of each fluid end module via the discharge outlet, a discharge manifold having an elongate manifold body configured to be operatively coupled to each fluid end module, the manifold body providing a first end, a second end, a discharge bore extending between the first and second ends, and one or more discharge inlets that fluidly communicate with the discharge bore, and a ring joint gasket arranged between each discharge inlet of the discharge manifold and a corresponding discharge outlet of the one or more fluid end modules.

22 Claims, 3 Drawing Sheets

(56) References Cited

U.S. PATENT DOCUMENTS

| | | | | |
|---|---|---|---|---|
| 6,209,445 | B1 | 4/2001 | Roberts, Jr. et al. | |
| 7,290,560 | B2 * | 11/2007 | Orr et al. | 137/454.6 |
| 8,074,679 | B2 | 12/2011 | Jensen et al. | |
| 8,465,268 | B2 | 6/2013 | Baxter et al. | |
| 2012/0063936 | A1 | 3/2012 | Baxter et al. | |
| 2012/0189477 | A1 | 7/2012 | Rogers | |

* cited by examiner

SEGMENTED FLUID END

CROSS-REFERENCE TO RELATED APPLICATIONS

This application is a National Stage entry of and claims priority to International Application No. PCT/US2013/065182, filed on Oct. 16, 2013, which claims priority to U.S. Provisional Patent Application Ser. No. 61/715,140, filed on Oct. 17, 2012.

BACKGROUND

The present disclosure is related to high-pressure pumps and, more particularly, to improved segmented fluid ends for high-pressure plunger pumps.

It is common practice in the oil and gas industry to use high-pressure positive displacement or reciprocating pumps (also known as plunger pumps) in a variety of field operations relating to the exploration, preparation, and extraction of hydrocarbons. For example, plunger pumps are often used in cementing a wellbore as part of a completion operation. Plunger pumps are also used in acidizing and hydraulically fracturing subterranean formations during wellbore treatment operations. The fluid end of such pumps is the portion of the pump where a fluid is drawn in via a suction valve and subsequently discharged under pressure. Within the fluid end of a plunger pump, a plunger or piston compresses the fluid and pushes it under pressure through a discharge valve. The discharge valve is typically designed to open upon experiencing a predetermined pressure differential across the valve.

Such pumps are frequently used in pumping two-phase slurries where solid particles are suspended in a liquid (e.g., proppant suspended in a fracturing fluid). At least one problem with pumping such two-phase slurries is that the slurry oftentimes makes the fluid end susceptible to damage in the form of erosion, wear and tear, hoop stress, and fatigue. Ultimately, such damage can result in bore enlargement or cracking of the fluid end, which may decrease efficiencies or otherwise require the pump to be shut down and repaired or replaced altogether. As can be appreciated, this may prove to be quite costly and time-consuming.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to high-pressure pumps and, more particularly, to improved segmented fluid ends for high-pressure plunger pumps.

Disclosed is a segmented fluid end that replaces conventional mono-block fluid ends requiring modifications to the power end of the pump. The presently disclosed segmented fluid end includes several fluid end modules arranged side-by-side and each fluidly and operatively coupled to an external discharge manifold. Corresponding grooves defined in each of the fluid end modules and the external discharge manifold are configured to cooperatively receive a ring joint gasket or ring joint type (RJT) gasket that helps to precisely align the discharge manifold laterally with respect to each of the modules. Advantageously, individual fluid end modules may be removed from the fluid end assembly when required without disturbing the remaining fluid end modules. Also, a strain bolt assembly or system may be included in each fluid end module in order to preload the intersection of vertical and horizontal bores defined within each fluid end module. The strain bolt assembly may help reduce hoop stress in the modules during operation.

Figure 1:
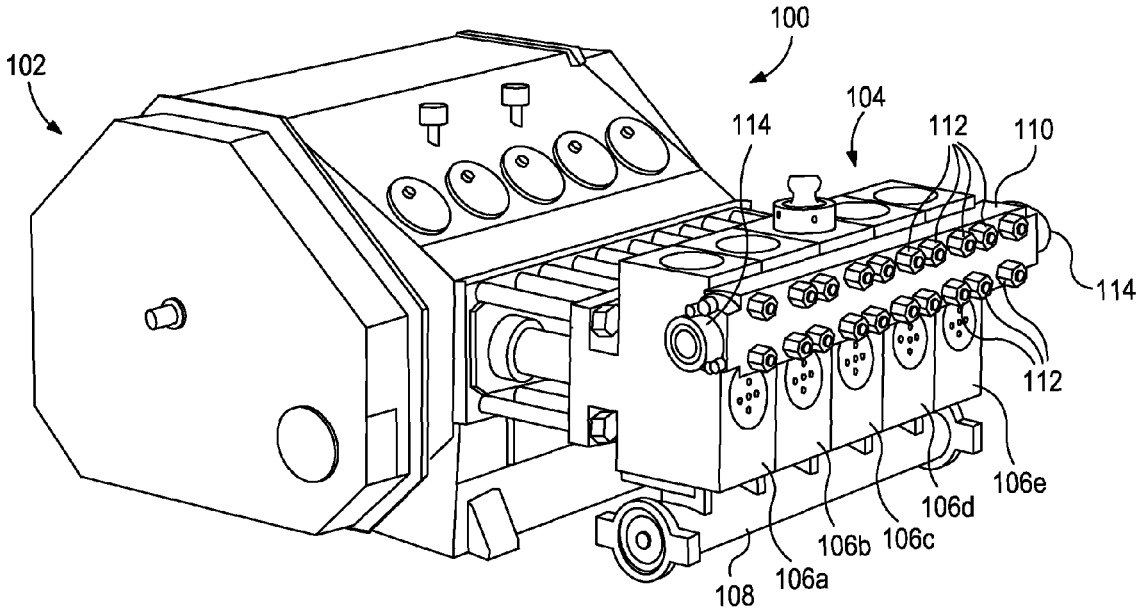
FIG. 1 is an isometric view of an exemplary high-pressure pump that may employ one or more principles of the present disclosure.

Referring to FIG. 1, illustrated is an exemplary high-pressure pump 100 that may employ one or more principles of the present disclosure. As illustrated, the pump 100 includes a power end 102 that houses a series of gears and rods (not shown), and a fluid end 104 operatively coupled to the power end 102. The illustrated pump 100 is depicted as a reciprocating or plunger pump. The pump 100 may be used in a variety of field operations relating to oil and gas wells, such as acidizing, hydraulic fracturing, cementing, and the like. It will be appreciated, however, that the pump 100, and the presently disclosed embodiments associated therewith, may be used in conjunction with other fields or technologies such as, but not limited to, agriculture, mining, food processing, and others readily recognized by those skilled in the art.

As used herein, the term "high-pressure" used to characterize the pumps described herein refers to fluid pumping pressures ranging between about 1000 psi to about 20,000 psi (about 6.89 MPa to about 137.89 MPa).

The pump 100 is illustrated as a quintuplex pump where the fluid end 104 provides or otherwise comprises five fluid end segments or modules 106 (shown as fluid end modules 106*a*, 106*b*, 106*c*, 106*d*, and 106*e*), generally arranged in a side-by-side relationship. Those skilled in the art will readily appreciate that the embodiments disclosed herein may equally be employed on high-pressure pumps having more or less than five fluid end modules 106*a-e* (including one), without departing from the scope of the disclosure. The fluid end modules 106*a-e* may be identical and interchangeable. The design and construction of the fluid end modules 106*a-e* will be explained in greater detail below.

The fluid end 104 includes a suction manifold 108 configured to feed or otherwise provide a working fluid into each fluid end module 106*a-e*. The fluid end 104 also provides or otherwise defines a discharge manifold 110 fluidly and operatively coupled to each fluid end module 106*a-e*. As discussed in greater detail below, the discharge manifold 110 is an external manifold system that is attached to each individual fluid end module 106*a-e* using a series of mechanical fasteners 112 (e.g., bolt and nut configuration). Each mechanical fastener 112 may extend through the body of the discharge manifold 110 and be threaded at least partially into each fluid end module 106*a-e*. Properly torquing and otherwise securing a nut to the end of each mechanical fastener (as depicted) ensures that the discharge manifold 110 is secured to each fluid end module 106*a-e* for operation.

Exemplary working fluids that may be used in the pump 100 may include, but are not limited, to fracturing fluids, fracturing slurries (i.e., solid particles suspended in a fracturing fluid), acids, cements, drilling fluids, and the like. In operation, the fluid end modules 106*a-e* collectively receive and pressurize the working fluid provided through the suction manifold 108, and subsequently feed the pressurized working fluid to the discharge manifold 110, which conveys the pressurized working fluid downstream to a wellbore, for example, via one or more discharge flanges 114.

Figure 2:
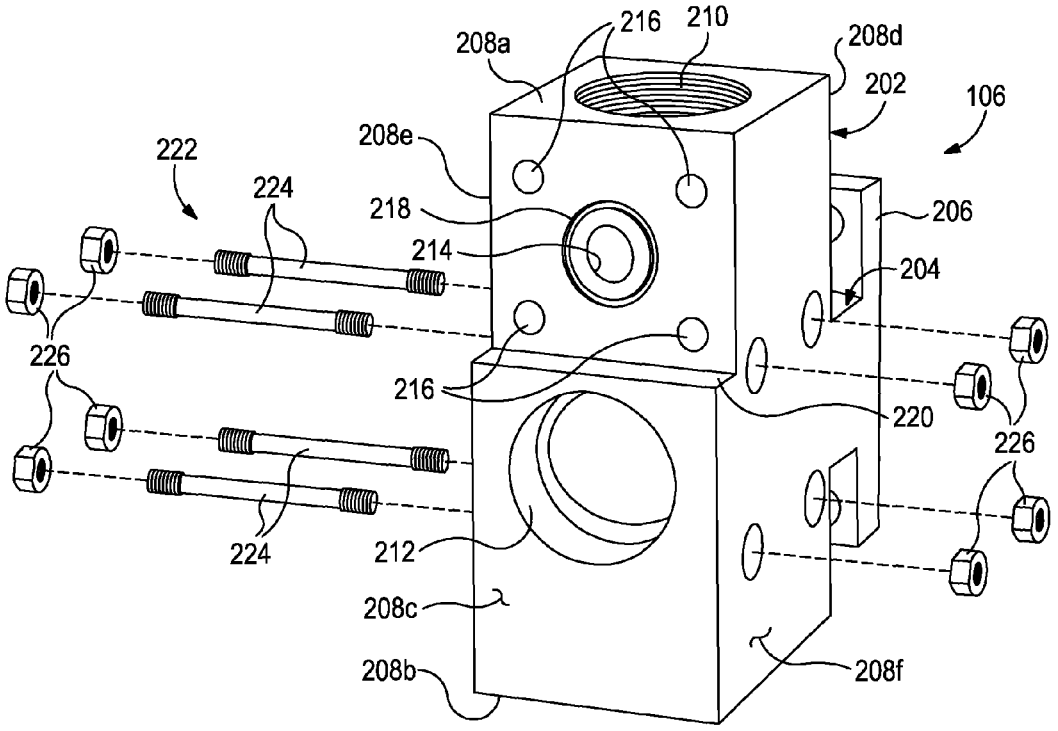
FIG. 2 illustrates an isometric view of a fluid end module of FIG. 1, according to one or more embodiments.

Referring now to FIG. 2, illustrated is an isometric view of one of the fluid end modules 106*a-e* of FIG. 1 (shown as fluid end module 106), according to one or more embodiments. The fluid end module 106 may be representative of any of the fluid end modules 106*a-e* of FIG. 1. The fluid end module 106 may include a body 202 and a leg 204 that extends from the body 202. The leg 204 may include or otherwise provide a flange 206 used to couple the module 106 to the power end 102 (FIG. 1). The body 202 of the module 106 may be made from a single piece of high tensile strength steel. In one embodiment, for example, the body 202 may be made of AISI 4340 steel that has been heat treated to a yield strength of at least 110 ksi (758.42 MPa). In other embodiments, the body 202 may be made of, but is not limited to AISI 4130 Normalized, Quenched, & Tempered (NQT) steel, AISI 4330 NQT, AISI 4340 NQT, and various grades of stainless steel. Suitable materials will exhibit a yield strength falling approximately within the range of about 100 ksi to about 150 ksi (1034.21 MPa).

Figure 4:
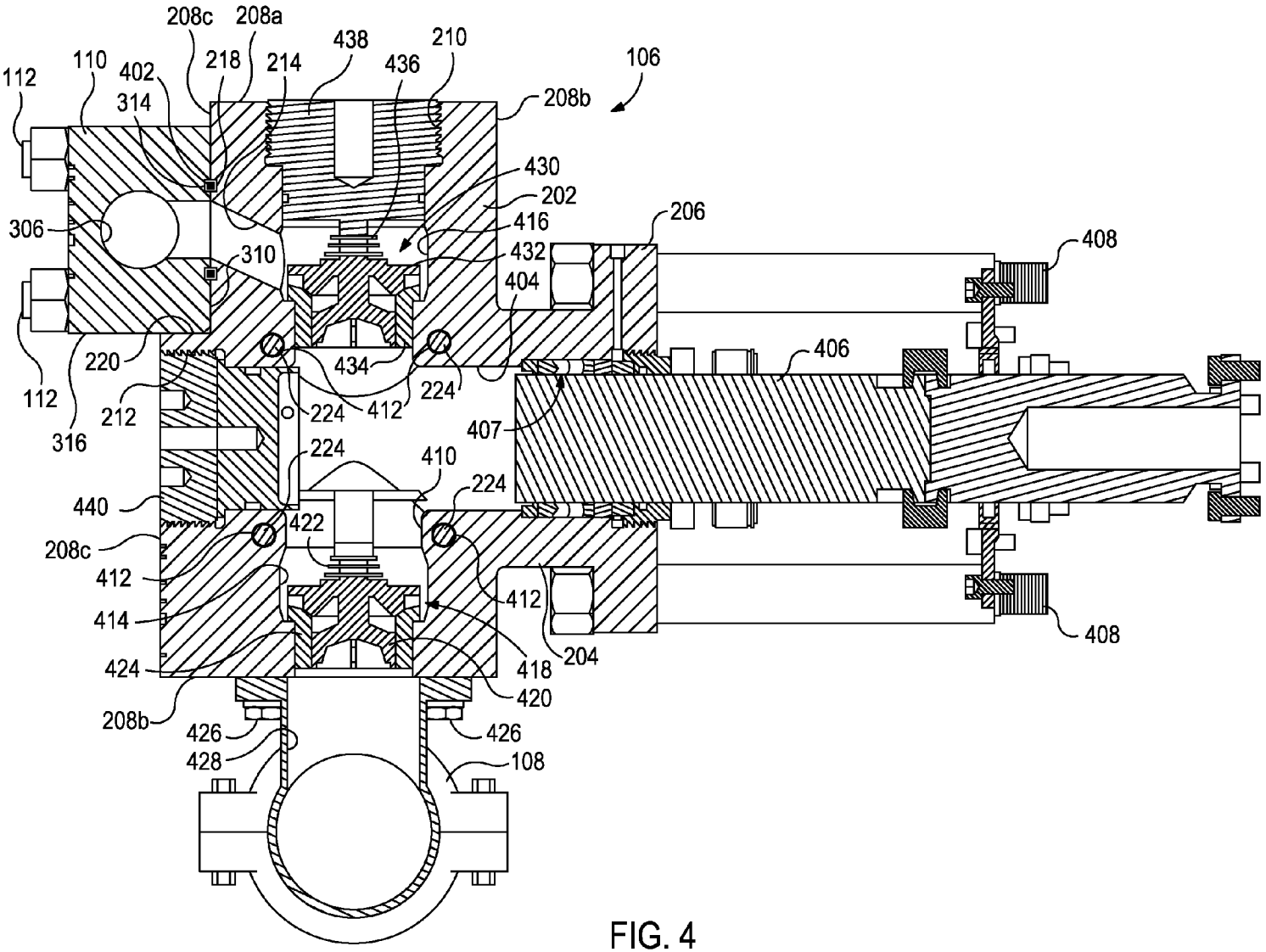
FIG. 4 illustrates a cross-sectional view of an exemplary fluid end module, according to one or more embodiments.

The body 202 may provide a top surface 208*a*, a bottom surface 208*b*, a front surface 208*c*, a back surface 208*d*, and opposing side surfaces 208*e* and 208*f*. The top surface 208*a* may define or otherwise provide a discharge cover orifice 210. In some embodiments, the discharge cover orifice 210 may be configured to receive a discharge valve cover 438 (FIG. 4). In other embodiments, however, the discharge cover orifice 210 may be configured to receive a pressure gauge or sensor (not shown) used to monitor pressures within the body 202.

The body 202 may further define a suction orifice 212 (also known as a suction valve cover opening or cylinder head opening) in the front surface 208*c*. The suction orifice 212 may provide user access into the interior of the body 202. During operation, however, the suction orifice 212 may be occluded with a suction valve cover 440 (FIG. 4). A discharge outlet 214 may also be defined in the body 202 in the front surface 208*c*. The discharge outlet 214 may be configured to be fluidly coupled to the discharge manifold 110 (FIG. 1) such that pressurized working fluid may be transmitted from the discharge outlet 214 to the discharge manifold 110.

One or more threaded holes 216 may be defined in the front surface 208*c* and used to secure the discharge manifold 110 the module 106. More particularly, as described above, the mechanical fasteners 112 (FIG. 1) may extend through the discharge manifold 110 and configured to be received by or otherwise thread into the holes 216. While four holes 216 are depicted in FIG. 2, those skilled in the art will readily appreciate that more or less than four holes 216 (and four corresponding mechanical fasteners 112) may be used to secure the discharge manifold 110 each module 106, without departing from the scope of the disclosure.

The body 202 may further provide a module seal groove 218 defined on the front surface 208*c*. As illustrated, the module seal groove 218 extends about the discharge outlet 214. As will be described in greater detail below, the module seal groove 218 may be configured to at least partially receive a ring joint gasket 402 (FIG. 4) that is matable with a corresponding groove defined in the discharge manifold 110 (FIG. 1). As the discharge manifold 110 is secured to the module 106, the ring joint gasket 402 may be configured to provide a sealed interface between the front surface 208*c* and an opposing surface on the discharge manifold 110. While shown in FIG. 2 as generally annular in shape, the module seal groove 218 may be defined in other shapes and configured to receive a sealing element exhibiting a substantially similar shape. For instance, the module seal groove 218 may be polygonal in shape, such as rectangular or square, without departing from the scope of the disclosure.

In some embodiments, the body 202 may further provide or otherwise define a ledge 220 configured to receive or seat a portion of the discharge manifold 110 (FIG. 1). The ledge 220 may prove advantageous in allowing a user to vertically align the discharge manifold 110 with the discharge outlet 214 and associated holes 216. In other embodiments, however, the ledge 220 may be omitted, without departing from the scope of the disclosure.

While the foregoing description provides the discharge manifold 110 as being coupled or otherwise attached to the front surface 208*c* of the body 202, it is further contemplated herein to attach the discharge manifold 110 to other surfaces or portions of the module 106. For instance, in some embodiments, the discharge outlet 214 may instead be provided on the body 202 at the back surface 208*d* of the body 202 such that the discharge manifold 110 may be coupled to the module 106 at the back surface 208*b* rather that at the front surface 208*c*. In other embodiments, the relative locations of the discharge cover orifice 210 and the discharge outlet 214 may be reversed such that the discharge manifold 110 may be coupled to the module 106 at the top surface 208*a* of the body 202, without departing from the scope of the disclosure. Those skilled in the art will readily recognize several structural variations that may be possible in coupling the external discharge manifold to the fluid end modules 106*a-e* (FIG. 1), without departing from the scope of this disclosure.

The module 106 may further include a strain bolt assembly 222 including one or more strain bolts 224 and corresponding nuts 226. As illustrated, each strain bolt 224 may be configured to extend laterally through the body 202 of the module 106, from one side 208*e* to the other side 208*f*, and be secured therein at opposing ends using the nuts 226. Accordingly, each end of the strain bolts 224 may be threaded and configured to threadably receive a corresponding nut 226 thereon. While four strain bolts 224 and eight corresponding nuts 226 are depicted in FIG. 2, those skilled in the art will readily appreciate that more or less than four strain bolts 224 (with their corresponding nuts 226) may be used, without departing from the scope of the disclosure.

The strain bolt assembly 222 may be configured to preload the module 106 and, more particularly, preload the intersection of the bores defined in the interior of the module 106. To accomplish this, the strain bolts 224 may be made of a material configured to provide an amount of tensile give while reducing hoop or circumferential stress within the internal bores of the body 202. For instance, in at least one embodiment, the strain bolts 224 may be grade seven (7) mechanical tensioner studs and the nuts 226 may be heavy hex nuts or torque nuts, each component being commercially-available under the name SUPERBOLT®. As will be appreciated, preloading the bores within the body 102 may prove advantageous in increasing the fatigue life for each module 106.

In some embodiments, the strain bolt assembly 222 may be installed at the time of manufacture of each module 106 and each strain bolt 224 may at that time be torqued to a predetermined and/or precise tensile value corresponding to a percentage of the yield strength of each strain bolt 224. After installation, the strain bolt assembly 222 need not be altered again, which takes the responsibility away from the user and thereby ensures proper torquing of the strain bolts 224 throughout operational use of the fluid end 106. In some embodiments, the strain bolt assembly 222 may be installed by the manufacturer using a thread locking adhesive so that a user will be unable to subsequently alter the torque value of each strain bolt 224.

Figure 3A:
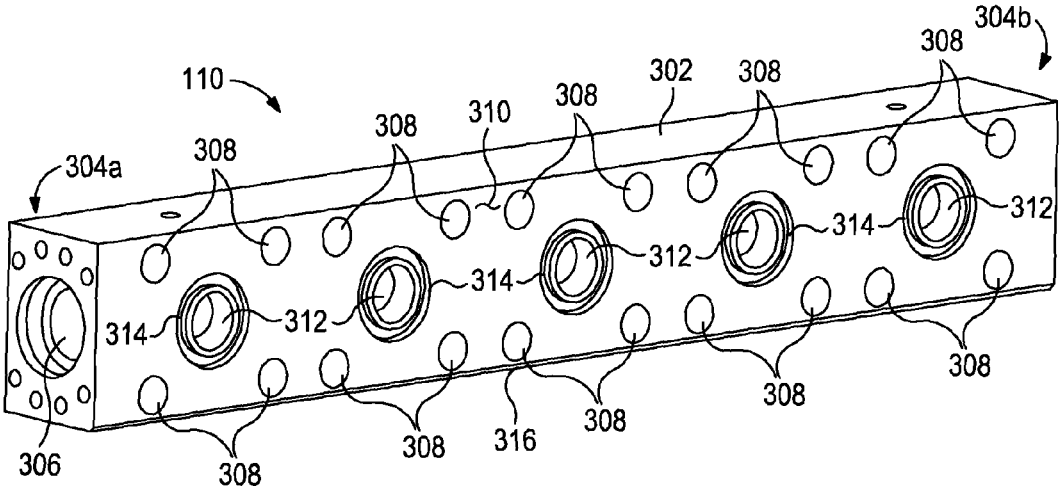
FIGS. 3A and 3B illustrate isometric and cross-sectional views, respectively, of the discharge manifold of FIG. 1, according to one or more embodiments.
Figure 3B:
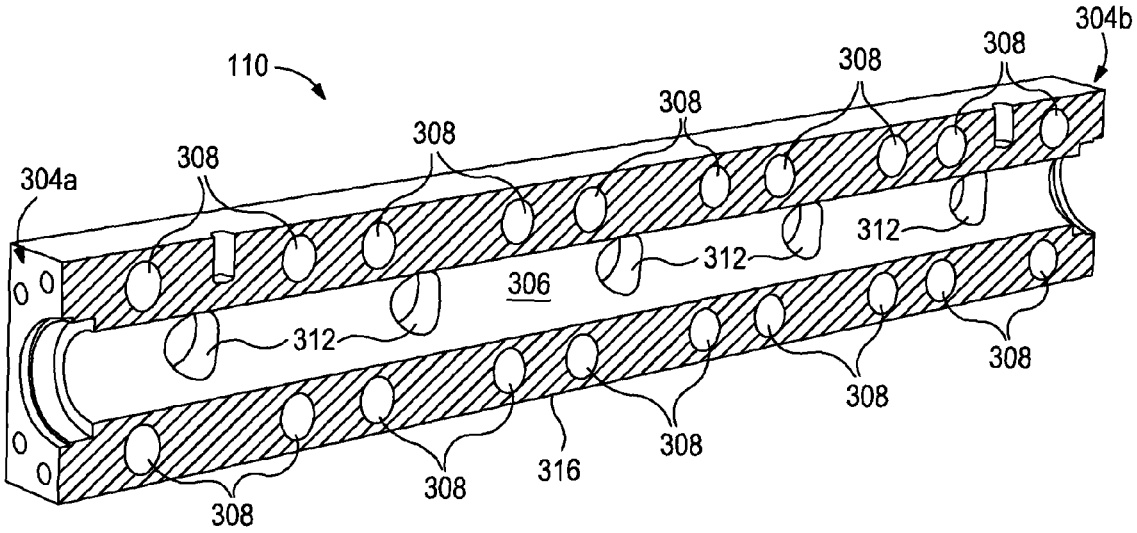

Referring now to FIGS. 3A and 3B, with continued reference to FIG. 2, illustrated are isometric and cross-sectional isometric views, respectively, of the discharge manifold 110 of FIG. 1, according to one or more embodiments. The discharge manifold 110 may include an elongate manifold body 302 having a first end 304*a* and a second end 304*b*. The manifold body 302 may be made of, for example, forged heat-treated steel. A discharge bore 306 may be defined longitudinally within the manifold body 302 and extend between the first and second ends 304*a,b*.

Each end 304*a,b* of the manifold body 302 may be configured to be coupled to either a discharge flange 114 (FIG. 1) or an end cap (not shown). The discharge flange(s) 114 may be configured to discharge pressurized working fluid from the discharge manifold 110 to a downstream location (e.g., a wellbore). The end cap (if used) may be configured to occlude or otherwise seal off the discharge bore 306 at one of the first or second ends 304*a,b*. Accordingly, depending on whether an end cap is used, pressurized working fluid may flow in either longitudinal direction within the discharge bore 306.

As mentioned above, the discharge manifold 110 may be arranged external to the modules 106*a-e* (FIG. 1) and coupled thereto using the mechanical fasteners 112 (FIG. 1). The mechanical fasteners 112 may be extended through corresponding through bores 308 defined in the manifold body 302 and threaded into the holes 216 (FIG. 2) of each fluid end module 106*a-e* (FIG. 1).

As illustrated, the manifold body 302 of the discharge module 110 may include a back face 310 that defines one or more discharge inlets 312. The discharge inlets 312 extend into the manifold body 302 and otherwise fluidly communicate with the discharge bore 306. Each discharge inlet 312 may be configured to mate with and otherwise sealingly engage a corresponding discharge outlet 214 (FIG. 2) of the fluid end modules 106*a-e* (FIG. 1). Accordingly, the number of discharge inlets 312 will equal the number of modules 106*a-e* included in the pump 100 (FIG. 1). In the illustrated embodiment, the discharge manifold 110 provides five discharge inlets 312 configured to align with a corresponding five fluid end modules 106*a-e*. In other embodiments, however, more or less than five discharge inlets 312 and fluid end modules 106*a-e* may be employed, without departing from the scope of the disclosure.

One or more discharge seal grooves 314 may be defined on the back face 308 of the discharge manifold 110 and otherwise associated with each discharge inlet 312. Each discharge seal groove 314 may be configured to align with a corresponding module seal groove 218 (FIG. 2) of an adjacent module 106*a-e* (FIG. 1). Accordingly, similar to the module seal groove 218, the discharge seal grooves 314 may be annular (as depicted), but may also be defined in other shapes, such as rectangular or square, without departing from the scope of the disclosure. A similarly shaped ring joint gasket 402 (FIG. 4) may be at least partially received or seated within each discharge seal groove 314 or corresponding module seal groove 218, and may generally interpose each groove 218, 314. Accordingly, as will be discussed below with reference to FIG. 4, a separate and distinct ring joint gasket 402 may be arranged between each aligned discharge inlet 312 and discharge outlet 214 (FIG. 2).

The discharge manifold 110 further defines or otherwise provides a bottom surface 316. In some embodiments, at least a portion of the bottom surface 316 may be seated on or otherwise received by the ledge 220 (FIG. 2) of each module 106*a-e* (FIG. 1), as discussed above with reference to FIG. 2.

Referring now to FIG. 4, with continued reference to FIGS. 2 and 3A-3B, illustrated is a cross-sectional view of one of the fluid end modules 106*a-e* of FIG. 1 (shown as fluid end module 106), according to one or more embodiments. Again, the fluid end module 106 may be representative of any of the fluid end modules 106*a-e* of FIG. 1, and like numerals used in prior figures will indicate like elements or components not described again in detail. Accordingly, the fluid end module 106 may be best understood with reference to the prior figures. As illustrated, the body 202 of the fluid end module 106 defines a plunger bore 404 and a piston or plunger 406 may be reciprocably disposed within the plunger bore 404. The plunger 406 may generally extend towards the power end 102 (FIG. 1) and the body 202 may be operatively coupled to the power end 102 using one or more stay rods 408 (two shown) configured to extend through corresponding orifices (not shown) defined in the flange 206.

One or more seals or compression packing assemblies 407 may be arranged about the plunger 406 within the plunger bore 404 to provide a sealing engagement between the body 202 and the plunger 406. During operation, as the plunger 406 reciprocates within the plunger bore 404, the compression packing assembly 407 prevents the working fluid from migrating along the length of the plunger 406 and out of the body 202 via the plunger bore 404.

The plunger bore 404 may be characterized as a horizontal bore, and the body 202 may further define or otherwise provide a vertical bore 410 that intersects the plunger bore 404 generally perpendicularly. At the intersection of the horizontal and vertical bores 404, 410, the body 202 may define or otherwise provide one or more strain bolt holes 412 (four shown), each configured to receive a corresponding strain bolt 224 from the strain bolt assembly 222 (FIG. 2). As generally described above, the strain bolts 224 may be configured to preload the intersection of the horizontal and vertical bores 404, 410 in order to reduce hoop stresses within the body 202 of the fluid end module 106. Using corresponding nuts 226 (FIG. 2), the strain bolts 224 may be torqued to a predetermined and/or precise torque or tensile value corresponding to the yield strength of each strain bolt 224. Reduced hoop stress in the horizontal and vertical bores 404, 410 may prove advantageous in increasing the fatigue life of the module 106.

Within the vertical bore 410, the body 202 may further define a suction valve pocket 414 and a discharge valve pocket 416, each of which are in fluid communication with the plunger bore 404 at the bore intersection. It should be noted that, while the discharge valve pocket 416 is depicted as being arranged within the vertical bore 410 and otherwise axially aligned with the suction valve pocket 414, embodiments are also contemplated herein where the discharge valve pocket 416 is axially aligned with the plunger bore 404, without departing from the scope of the disclosure.

The suction valve pocket 414 has an inlet valve assembly 418 arranged therein, and the inlet valve assembly 418 generally includes a suction valve 420 biased by a spring 422 against a suction valve seat 424. The suction manifold 108 may define or otherwise provide a suction inlet conduit 428 configured to be aligned with the suction valve pocket 414 and the inlet valve assembly 418. The suction manifold 108 may be coupled to the body 202 of the module 106 using one or more mechanical fasteners 426 (two shown). In operation, the suction manifold 108 feeds working fluid into the suction valve pocket 414 via the suction inlet conduit 428 to be compressed.

Referring briefly again to FIG. 1, similar to the discharge manifold 110, the suction manifold 108 includes an elongate body that may be operatively and fluidly coupled to each fluid end module 106*a-e*. As will be appreciated, coupling the suction manifold 108 to each of the modules 106*a-e* using the mechanical fasteners 426 (FIG. 4) may provide a measure of rigidity and/or stability to the fluid end 104 and otherwise make the configuration of the laterally-spaced modules 106*a-e* more robust.

Referring once again to FIG. 4, a discharge valve assembly 430 is arranged within the discharge valve pocket 416 and includes a discharge valve 432 positioned adjacent a discharge valve seat 434 and biased by a spring 436. The discharge outlet 214 may be in fluid communication with the discharge valve pocket 416 and otherwise providing a fluid conduit through which pressurized working fluid may enter the discharge manifold 110. The spring 436 may interpose the discharge valve 432 and a discharge valve cover 438 received or otherwise secured within the discharge cover orifice 210. In other embodiments, as mentioned above, the discharge valve cover 438 may be replaced with a pressure gauge or sensor (not shown) used to monitor pressures within the discharge valve pocket 416.

As illustrated, a suction valve cover 440 may be received or otherwise secured within the suction orifice 212 on the front surface 208*c* of the body 202. Moreover, a portion of the discharge manifold 110 (i.e., the bottom surface 316) may be seated on or otherwise received by the ledge 220 such that the discharge inlet 312 may be axially and laterally aligned with the discharge outlet 214.

In other embodiments, however, the ledge 220 may be omitted and the ring joint gasket 402 may be used to help accurately align the discharge manifold 110 with the fluid end module 106. More particularly, as indicated above, the ring joint gasket 402 may be configured to be at least partially received or seated within both the discharge seal groove 314 and the module seal groove 218. As the mechanical fasteners 112 are tightened, the back face 310 of the discharge manifold 110 is brought into engagement with the front surface 208*c* of the body 202. During this movement, the ring joint gasket 402 may be cooperatively received within each of the module and discharge seal grooves 218, 314, thereby helping to axially align the discharge inlet 312 accurately with the discharge outlet 214.

The ring joint gasket 402 may be any type of sealing element configured to seal a joint or interface. In some embodiments, for example, the ring joint gasket 402 may be a soft iron API ring or a joint seal known to those skilled in the art. As the mechanical fasteners 112 are torqued, the ring joint gasket 402 may be configured to deform or otherwise be crushed within the module and discharge seal grooves 218, 314, thereby resulting in a generally fluid tight and/or sealed interface between the discharge outlet 214 and the discharge inlet 312. In other embodiments, however, one or more of the ring joint gaskets 402 may be an elastomeric sealing element, such as an O-ring or the like, without departing from the scope of the disclosure. The sealed interface provided by the ring joint gasket 402 provides sealed fluid communication between the fluid end module 106 and the discharge module 110.

As will be appreciated, arranging the ring joint gasket 402 in each of the grooves 218, 314 helps a user precisely align the discharge manifold 110 to each fluid end module 106*a-e* (FIG. 1). Conventional modular fluid end systems are usually clamped together longitudinally in order to provide acceptable alignment. This requires that the width of each module have extremely accurate tolerances in order to avoid alignment problems that may be introduced by stacking up individual modules. Here, however, the ring joint gasket 402 serves as a guide configured to axially and laterally align the discharge manifold 110 with the fluid end module 106*a-e*. Those skilled in the art will readily appreciate the alignment advantages realized by using the ring joint gaskets 402 since the cylinders of the present embodiment are housed in separate modules 106*a-e*, whereas in conventional mono-block fluid ends they encompassed a single ridged block. In embodiments where the ring joint gasket 402 is an elastomeric sealing element, such as an O-ring or the like, one or more aligning devices may be used in order to ensure that each module 106*a-e* (FIG. 1) is suitably aligned laterally. For instance, dowel pins or roll pins (not shown) may be employed to help align the fluid end modules 106*a-e*.

In exemplary operation of the fluid end module 106, working fluid is provided to the body 202 of the fluid end module 106 from the suction manifold 108 and via the inlet valve assembly 418 arranged in the suction valve pocket 414. The plunger 406 is powered to reciprocate toward and away from the intersection of the horizontal and vertical bores 404, 410 in order to pressurize the incoming working fluid. In this manner, the plunger 406 affects high and low pressures on the discharge valve pocket 416. For example, as the plunger 406 is thrust toward the intersection of the bores 404, 410, the pressure within the discharge valve pocket 416 is increased.

At some point, the pressure increase will be sufficient to open the discharge valve 432 and thereby allow the release of the pressurized working fluid from the discharge valve pocket 416, through the discharge outlet 214, and into the discharge inlet 312, which feeds the discharge bore 306 of the discharge manifold 110. The amount of pressure required to open the discharge valve 432 may be determined, at least in part, by the spring 436, which maintains the discharge valve 432 in its closed position until the requisite pressure is achieved in the discharge valve pocket 416.

The plunger 406 may also affect a low pressure on the discharge valve pocket 416. That is, as the plunger 406 retracts away from its advanced discharge position near the intersection of the bores 404, 410, the pressure at the intersection will decrease, thereby decreasing the pressure within the discharge valve pocket 416 and forcing the discharge valve 432 to close and otherwise return the discharge valve pocket 416 to a sealed state. As the plunger 406 continues to move away from the discharge valve pocket 416, the pressure therein will continue to drop, and eventually a low or negative pressure will be achieved within the discharge valve pocket 416.

The pressure decrease will eventually be sufficient to affect an opening of the suction valve 420 arranged within the inlet valve assembly 418. Opening the suction valve 420 allows the uptake of working fluid into the suction valve pocket 414 from the suction inlet conduit 428 of the suction manifold 108 fluidly coupled thereto. The amount of pressure required to open the suction valve 420 may be determined by the spring 422, which keeps the suction valve 420 in its closed position until the requisite low pressure is achieved in the suction valve pocket 414.

Accordingly, the reciprocating or cycling motion of the plunger 406 within the plunger bore 406 controls the pressure within the body 202. The suction and discharge valves 420, 432 respond accordingly in order to dispense pressurized working fluid from the discharge valve pocket 416, through the discharge outlet 214, and into the discharge bore 306 of the discharge manifold 110 via the discharge inlet 312. The discharged working fluid is then replaced with additional working fluid derived from the suction manifold 108.

Besides the several advantages already mentioned above, those skilled in the art will readily appreciate the several additional advantages that the presently disclosed segmented fluid end module 106 and fluid end 104 (FIG. 1) provides. For instance, a single module 106 may be quickly removed from the fluid end 104 without disturbing the remaining fluid end modules 106*a-e*. This may be done by removing the mechanical fasteners 112, 426 that couple the external discharge manifold 110 and the suction manifold 108, respectively, to the module 106. Once the corresponding mechanical fasteners 112, 426 are removed, the module 106 may be removed from the remaining modules 106*a-e* (FIG. 1) for repairs or replacement.

Moreover, the external discharge manifold 110 of the module 106 supplies a degree of rigidity to the fluid end 104. More particularly, mechanically fastening the discharge manifold 110 to each fluid end module 106*a-e* serves to structurally couple each module 106*a-e* together. Such rigidity and robustness is lost on typical systems that separate monoblock cylinders into individual segments. Also, the external discharge manifold 110 does not generate axial reaction forces that could damage the fluid end module 106. For instance, conventional systems typically use hollow cylindrical manifold segments that connect individual fluid end modules together in a common discharge, but also generate axial forces much the same way that a hydraulic or pneumatic cylinder creates force. In order to retain these forces, bulky clamping systems or restraining bolts that run the complete width of the fluid end assembly are typically used. As can be appreciated, these clamping systems and/or restraining bolts can be problematic because they rely on the user to properly install and tighten them to the proper torque values to ensure their proper function.

Embodiments disclosed herein include:

A. A segmented fluid end that includes one or more fluid end modules, each fluid end module including a body providing a plunger bore configured to receive a plunger therein and a discharge outlet in fluid communication with the plunger bore, wherein a pressurized working fluid may exit the body of each fluid end module via the discharge outlet, a discharge manifold having an elongate manifold body configured to be operatively coupled to each fluid end module, the manifold body providing a first end, a second end, a discharge bore extending between the first and second ends, and one or more discharge inlets that fluidly communicate with the discharge bore, and a ring joint gasket arranged between each discharge inlet of the discharge manifold and a corresponding discharge outlet of the one or more fluid end modules.

B. A method of operating a segmented fluid end. The method may include reciprocating a plunger within a plunger bore defined within a body of one or more fluid end modules, discharging a pressurized working fluid via a discharge outlet defined in each body of the one or more fluid end modules, receiving the pressurized working fluid with a discharge manifold having an elongate manifold body coupled to the body of each fluid end module, the manifold body providing a first end, a second end, a discharge bore extending between the first and second ends, and one or more discharge inlets that fluidly communicate with the discharge bore and a corresponding discharge outlet of each fluid end module, and laterally aligning each discharge inlet of the discharge manifold with the corresponding discharge outlet of each fluid end module with a corresponding ring joint gasket arranged between each discharge inlet and the corresponding discharge outlet.

C. A pump that includes a power end, at least two fluid end modules arranged in a side-by side relationship and operatively coupled to the power end, each fluid end module including a body providing a plunger bore configured to receive a plunger therein and a discharge outlet in fluid communication with the plunger bore, wherein a pressurized working fluid may exit the body of each fluid end module via the discharge outlet, a discharge manifold having an elongated manifold body configured to be operatively coupled to the at least two fluid end modules, the manifold body providing a first end, a second end, a discharge bore extending between the first and second ends, and one or more discharge inlets that fluidly communicate with the discharge bore, and a ring joint gasket arranged between each discharge inlet of the discharge manifold and a corresponding discharge outlet of the one or more fluid end modules.

Each of embodiments A, B, and C may have one or more of the following additional elements in any combination: Element 1: further comprising a module seal groove extending about the discharge outlet of each fluid end module, and one or more discharge seal grooves defined on the manifold body, each discharge seal groove extending about a corresponding discharge inlet, wherein each ring joint gasket is at least partially received within each adjacent module seal grooves and discharge seal grooves and configured to laterally align the manifold body with each fluid end module. Element 2: wherein each ring joint gasket is at least one of a soft iron API ring and an elastomeric sealing element, and the ring joint gasket is configured to seal an interface between the manifold body and each fluid end module. Element 3: wherein the ring joint gasket is one of annular or polygonal in shape. Element 4: further comprising a suction manifold having an elongate suction body operatively and fluidly coupled to each of the fluid end modules. Element 4: wherein the manifold body is fastened to the body of each fluid end module using one or more mechanical fasteners that extend through the manifold body and are received by one or more corresponding holes defined in the body of each fluid end module. Element 5: wherein the body of each fluid end module defines a ledge configured to seat a portion of the discharge manifold and thereby vertically align the discharge inlets with each discharge outlet. Element 6: wherein the discharge outlet of each fluid end module is defined on a front surface of the body of each fluid end module and the discharge manifold is coupled to the front surface of the body of each fluid end module. Element 7: wherein the discharge outlet of each fluid end module is defined on a back surface of the body of each fluid end module and the discharge manifold is coupled to the back surface of the body of each fluid end module. Element 8: further comprising a strain bolt assembly configured to preload the body of each fluid end module. Element 9: wherein the plunger bore is a horizontal bore and the body further defines a vertical bore, and wherein the strain bolt assembly comprises one or more strain bolts configured to extend through the body at or near an intersection between the horizontal and vertical bores, and a plurality of nuts threadably received at one or both ends of each of the one or more strain bolts and configured to secure the one or more strain bolts within the body, wherein the one or more strain bolts are torqued to a predetermined tensile value in order to preload the horizontal and vertical bores and thereby reduce hoop stress therein.

Element 10: wherein a module seal groove extends about the discharge outlet of each fluid end module and each discharge inlet includes a corresponding discharge seal groove defined thereabout, the method further comprising arranging the corresponding ring joint gasket at least partially within adjacent module seal grooves and discharge seal grooves. Element 11: further comprising fastening the manifold body to the body of each fluid end module using one or more mechanical fasteners, and sealing an interface between the discharge manifold and the body of each fluid end module with the ring joint gasket as the mechanical fasteners are torqued, wherein the ring joint gasket is at least one of a soft iron API ring and an elastomeric sealing element. Element 12: further comprising seating a portion of the discharge manifold on a ledge defined on the body of each fluid end module, and thereby vertically aligning the one or more discharge inlets with the discharge outlet of each fluid end module. Element 13: wherein the discharge outlet of each fluid end module is defined on a front surface of the body of each fluid end module, the method further comprising coupling the discharge manifold to the front surface of the body of each fluid end module. Element 14: wherein the discharge outlet of each fluid end module is defined on a back surface of the body of each fluid end module, the method further comprising coupling the discharge manifold to the back surface of the body of each fluid end module. Element 15: wherein the plunger bore is a horizontal bore and the body of each fluid end module further defines a vertical bore, the method further comprising preloading an intersection between the horizontal and vertical bores in each fluid end module. Element 16: wherein preloading the intersection between the horizontal and vertical bores comprises extending one or more strain bolts through the body of each fluid end module at or near the intersection between the horizontal and vertical bores, threadably attaching nuts at one or both ends of each of the one or more strain bolts, and torquing each of the one or more strain bolts to a predetermined tensile value.

Element 17: further comprising a module seal groove extending about the discharge outlet of each fluid end module, and one or more discharge seal grooves defined on the manifold body, each discharge seal groove extending about a corresponding discharge inlet, wherein each ring joint gasket is at least partially received within each adjacent module seal groove and discharge seal groove and configured to laterally align the manifold body with each fluid end module. Element 18: wherein the ring joint gasket is at least one of a soft iron API ring and an elastomeric sealing element, and wherein the ring joint gasket is configured to provide a fluid tight interface between adjacent discharge outlets and discharge inlets. Element 19: further comprising a suction manifold having an elongate suction body operatively and fluidly coupled to each of the at least two fluid end modules. Element 20: further comprising a strain bolt assembly configured to preload the body of each fluid end module. Element 21: wherein the plunger bore is a horizontal bore and the body further defines a vertical bore, and wherein the strain bolt assembly comprises one or more strain bolts configured to extend through the body at or near an intersection between the horizontal and vertical bores, and nuts threadably received at one or both ends of each of the one or more strain bolts and configured to secure the one or more strain bolts within the body, wherein the one or more strain bolts are torqued to a predetermined tensile value in order to preload the horizontal and vertical bores and thereby reduce hoop stress therein.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A segmented fluid end, comprising:

one or more fluid end modules, each fluid end module including a body providing a plunger bore configured to receive a plunger therein and a discharge outlet in fluid communication with the plunger bore, wherein a pressurized working fluid may exit the body of each fluid end module via the discharge outlet;

a discharge manifold having an elongate manifold body configured to be operatively coupled to each fluid end module, the manifold body providing a first end, a second end, a discharge bore extending between the first and second ends, and one or more discharge inlets that fluidly communicate with the discharge bore;

a strain bolt assembly configured to preload the body of each fluid end module, wherein the strain bolt assembly comprises one or more strain bolts configured to extend through opposing sides of the body; and a ring joint gasket arranged between each discharge inlet of the discharge manifold and a corresponding discharge outlet of the one or more fluid end modules.

2. The segmented fluid end of claim 1, further comprising:

a module seal groove extending about the discharge outlet of each fluid end module; and one or more discharge seal grooves defined on the manifold body, each discharge seal groove extending about a corresponding discharge inlet, wherein each ring joint gasket is at least partially received within each adjacent module seal grooves and discharge seal grooves and configured to laterally align the manifold body with each fluid end module.

3. The segmented fluid end of claim 2, wherein each ring joint gasket is at least one of a soft iron API ring and an elastomeric sealing element, and the ring joint gasket is configured to seal an interface between the manifold body and each fluid end module.

4. The segmented fluid end of claim 2, wherein the ring joint gasket is one of annular or polygonal in shape.

5. The segmented fluid end of claim 1, further comprising a suction manifold having an elongate suction body operatively and fluidly coupled to each of the fluid end modules.

6. The segmented fluid end of claim 1, wherein the manifold body is fastened to the body of each fluid end module using one or more mechanical fasteners that extend through the manifold body and are received by one or more corresponding holes defined in the body of each fluid end module.

7. The segmented fluid end of claim 1, wherein the body of each fluid end module defines a ledge configured to seat a portion of the discharge manifold and thereby vertically align the discharge inlets with each discharge outlet.

8. The segmented fluid end of claim 1, wherein the discharge outlet of each fluid end module is defined on a front surface of the body of each fluid end module and the discharge manifold is coupled to the front surface of the body of each fluid end module.

9. The segmented fluid end of claim 1, wherein the plunger bore is a horizontal bore and the body further defines a vertical bore, and wherein the one or more strain bolts of the strain bolt assembly are configured to extend through opposing sides of the body at or near an intersection between the horizontal and vertical bores; and wherein the strain bolt assembly further comprises:

a plurality of nuts configured to be threadably received on one or both ends of each of the one or more strain bolts and configured to secure the one or more strain bolts within the body;

wherein the one or more strain bolts are configured to be torqued to a predetermined tensile value by threaded engagement with the plurality of nuts to preload the horizontal and vertical bores.

10. The fluid end of claim 1, wherein the one or more strain bolts of the strain bolt assembly are configured to extend through opposing sides of the body in a direction that is perpendicular to a longitudinal direction of the plunger bore.

11. A method of operating a segmented fluid end, comprising:

reciprocating a plunger within a plunger bore defined within a body of one or more fluid end modules, wherein the plunger bore is a horizontal bore and the body of each fluid end module further defines a vertical bore;

preloading an intersection between the horizontal and vertical bores in each fluid end module by extending one or more strain bolts through opposing sides of the body of each fluid end module;

discharging a pressurized working fluid via a discharge outlet defined in each body of the one or more fluid end modules;

receiving the pressurized working fluid with a discharge manifold having an elongate manifold body coupled to the body of each fluid end module, the manifold body providing a first end, a second end, a discharge bore extending between the first and second ends, and one or more discharge inlets that fluidly communicate with the discharge bore and a corresponding discharge outlet of each fluid end module; and laterally aligning each discharge inlet of the discharge manifold with the corresponding discharge outlet of each fluid end module with a corresponding ring joint gasket arranged between each discharge inlet and the corresponding discharge outlet.

12. The method of claim 11, wherein a module seal groove extends about the discharge outlet of each fluid end module and each discharge inlet includes a corresponding discharge seal groove defined thereabout, the method further comprising arranging the corresponding ring joint gasket at least partially within adjacent module seal grooves and discharge seal grooves.

13. The method of claim 12, further comprising:

fastening the manifold body to the body of each fluid end module using one or more mechanical fasteners; and sealing an interface between the discharge manifold and the body of each fluid end module with the ring joint gasket as the mechanical fasteners are torqued, wherein the ring joint gasket is at least one of a soft iron API ring and an elastomeric sealing element.

14. The method of claim 11, further comprising seating a portion of the discharge manifold on a ledge defined on the body of each fluid end module, and thereby vertically aligning the one or more discharge inlets with the discharge outlet of each fluid end module.

15. The method of claim 11, wherein the discharge outlet of each fluid end module is defined on a front surface of the body of each fluid end module, the method further comprising coupling the discharge manifold to the front surface of the body of each fluid end module.

16. The method of claim 11, wherein preloading the intersection between the horizontal and vertical bores further comprises:

extending the one or more strain bolts through opposing sides of the body of each fluid end module at or near the intersection between the horizontal and vertical bores;

threadably attaching nuts at one or both ends of each of the one or more strain bolts; and torqueing each of the one or more strain bolts to a predetermined tensile value.

17. The method of claim 11, wherein extending one or more strain bolts through opposing sides of the body of each fluid end module further comprises extending the one or more strain bolts through opposing sides of the body of each fluid end module in a direction that is perpendicular to a longitudinal direction of the plunger bore.

18. A pump, comprising:

a power end;

at least two fluid end modules arranged in a side-by side relationship and operatively coupled to the power end, each fluid end module including a body providing a plunger bore configured to receive a plunger therein and a discharge outlet in fluid communication with the plunger bore, wherein a pressurized working fluid may exit the body of each fluid end module via the discharge outlet, and wherein the plunger bore is a horizontal bore and the body further defines a vertical bore;

a discharge manifold having an elongated manifold body configured to be operatively coupled to the at least two fluid end modules, the manifold body providing a first end, a second end, a discharge bore extending between the first and second ends, and one or more discharge inlets that fluidly communicate with the discharge bore;

a strain bolt assembly configured to preload the body of each fluid end module, wherein the strain bolt assembly comprises:

one or more strain bolts configured to extend through the body at or near intersection between the horizontal and vertical bores; and nuts threadably received at one or both ends of each of the one or more strain bolts and configured to secure the one or more strain bolts within the body, wherein the one or more strain bolts are torqued to a predetermined tensile value in order to preload the horizontal and vertical bores and thereby reduce hoop stress therein; and a ring joint gasket arranged between each discharge inlet of the discharge manifold and a corresponding discharge outlet of the one or more fluid end modules.

19. The pump of claim 18, further comprising:

a module seal groove extending about the discharge outlet of each fluid end module; and one or more discharge seal grooves defined on the manifold body, each discharge seal groove extending about a corresponding discharge inlet, wherein each ring joint gasket is at least partially received within each adjacent module seal groove and discharge seal groove and configured to laterally align the manifold body with each fluid end module.

20. The pump of claim 19, wherein the ring joint gasket is at least one of a soft iron API ring and an elastomeric sealing element, and wherein the ring joint gasket is configured to provide a fluid tight interface between adjacent discharge outlets and discharge inlets.

21. The pump of claim 18, further comprising a suction manifold having an elongate suction body operatively and fluidly coupled to each of the at least two fluid end modules.

22. The pump of claim 18, wherein the one or more strain bolts of the strain bolt assembly are configured to extend through the body in a direction that is perpendicular to a longitudinal direction of the plunger bore.

* * * * *